US007650088B2

(12) United States Patent
Kim et al.

(10) Patent No.: US 7,650,088 B2
(45) Date of Patent: Jan. 19, 2010

(54) APPARATUS AND METHOD FOR RECOGNIZING ERROR OF TONER SENSOR FOR DEVELOPING DEVICE

(75) Inventors: Gun Ho Kim, Seoul (KR); Cheol Ju Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 181 days.

(21) Appl. No.: 11/848,983

(22) Filed: Aug. 31, 2007

(65) Prior Publication Data

US 2008/0089701 A1 Apr. 17, 2008

(30) Foreign Application Priority Data

Oct. 13, 2006 (KR) ..... 10-2006-0099875

(51) Int. Cl.
*G03G 15/00* (2006.01)
*G03G 15/08* (2006.01)

(52) U.S. Cl. ..... 399/27; 399/53

(58) Field of Classification Search ..... 399/27, 399/29, 53, 258, 260; 347/19; 358/406, 358/504

See application file for complete search history.

(56) References Cited

U.S. PATENT DOCUMENTS 4,896,184 A 1/1990 Kamitamari et al. ..... 399/29
4,934,314 A 6/1990 Ideyama ..... 399/30
5,218,409 A 6/1993 Tanaka et al. ..... 399/59
5,532,791 A 7/1996 Takahashi et al. ..... 399/18
5,754,916 A 5/1998 Kitayama et al. ..... 399/27
6,553,191 B1 * 4/2003 Nakane ..... 399/38

FOREIGN PATENT DOCUMENTS

JP 2003-195622 7/2003

OTHER PUBLICATIONS

Extended European Search Report issued Jan. 4, 2008 re: European Patent Application No. 07116787.8-1240 (10 pp).

Office Action issued in Chinese Patent Application No. 200710170194X on Feb. 1, 2009.

* cited by examiner

*Primary Examiner*—Sophia S Chen
(74) *Attorney, Agent, or Firm*—Stein McEwen, LLP

(57) ABSTRACT

An apparatus and a method recognizing the error of a toner sensor that is capable of correctly recognizing the error factor of the toner sensor for sensing the amount of the toner of a developing device main body. The output value and the set value of the sensor are compared with each other to display the corresponding error code. Therefore, a service engineer or a user easily recognizes the error factor to take proper measures corresponding to the error factor.

24 Claims, 9 Drawing Sheets

| ERROR CODE | ERROR CONTENT | SENSOR VALUE |
|---|---|---|
| E1 | TONER SUPPLYING HOLE OF DEVELOPING DEVICE IS CLOSED (CONTAMINATED) | NO MORE THAN 15 |
| E2 | LIGHT EMITTING UNIT OF SENSOR IS DEFECTIVE | NO LESS THAN 250 |
| E3 | CIRCUIT OF LIGHT RECEIVING UNIT OF SENSOR IS SHORTED | SPECIFIC VALUE (FIXED) |
| E4 | TONER IN DEVELOPING DEVICE IS EQUAL TO OR LESS THAN LOWERMOST VALUE | NO MORE THAN Te |
| E5 | AGITATION OF TONER IN DEVELOPING DEVICE IS NOT PROPERLY PERFORMED | NO MORE THAN 15 |

Fig.6

| ERROR CODE | ERROR CONTENT | SENSOR VALUE |
|---|---|---|
| E1 | TONER SUPPLYING HOLE OF DEVELOPING DEVICE IS CLOSED (CONTAMINATED) | NO MORE THAN 15 |
| E2 | LIGHT EMITTING UNIT OF SENSOR IS DEFECTIVE | NO LESS THAN 250 |
| E3 | CIRCUIT OF LIGHT RECEIVING UNIT OF SENSOR IS SHORTED | SPECIFIC VALUE (FIXED) |
| E4 | TONER IN DEVELOPING DEVICE IS EQUAL TO OR LESS THAN LOWERMOST VALUE | NO MORE THAN Te |
| E5 | AGITATION OF TONER IN DEVELOPING DEVICE IS NOT PROPERLY PERFORMED | NO MORE THAN 15 |

APPARATUS AND METHOD FOR RECOGNIZING ERROR OF TONER SENSOR FOR DEVELOPING DEVICE

CROSS-REFERENCE TO RELATED APPLICATION

This application claims the benefit of Korean Application No. 2006-99875, filed Oct. 13, 2006 in the Korean Intellectual Property Office, the disclosure of which is incorporated herein by reference.

BACKGROUND OF THE INVENTION

1. Field of the Invention

Aspects of the present invention relate generally to an apparatus and a method for recognizing an error of a toner sensor for a developing device, and more particularly to an apparatus and a method for recognizing an error of a toner sensor for a developing device that compares the output value and the set value of a toner sensor accommodated in a main body of the developing device with each other to correctly recognize the error.

2. Description of the Related Art

In general, in a copier, a printer, a multifunction printer, and a facsimile, in order to record an image on a recording medium using a developer such as a toner, an image forming apparatus of an electro-photography method is provided. Such an image forming apparatus is divided into a mono image forming apparatus and a color image forming apparatus. A mono image forming apparatus forms a single color image. A color image forming apparatus overlaps yellow (Y), magenta (M), cyan (C), and black (K) colors with each other to realize a desired image. Therefore, the mono image forming apparatus requires a developing cartridge of one color and the color image forming apparatus requires four developing cartridges that store toners of four colors, respectively.

On the other hand, the developing cartridge is divided into a monolithic structure in which a toner is stored in the developing cartridge and a separate structure in which a toner container in which a toner is stored is separate from the main body of a developing device. In the case of the monolithic structure, the developing cartridge is exchanged with a new developing cartridge after the toner is used. However, in the case of the separate structure, after the toner is used, the main body of the developing device is left as it is and the empty toner container is exchanged with a new toner container. Therefore, the separate structure is more economical.

In the case of the separate structure, since the toner of the toner container is supplied to the main body of the developer, it is necessary to determine whether the toner exists in the main body of the developing device as well as in the toner container. When a sensor that senses the toner of the main body of the developing device is provided, the reliability of the output value of the sensor must be secured.

When the reliability of the output value of the sensor is not secured, the amount of the toner filled in the main body of the developing device may be erroneously determined. When it is determined that the toner is insufficient by the sensor value measured using the sensor although the main body of the developing device is filled with the toner, the toner is unnecessarily supplied. As a result, the main body of the developing device may explode. Also, when it is determined that the toner is sufficient by the sensor value although the toner in the main body of the developing device is exhausted so that the toner must be supplied, since the toner is not supplied from the toner container to the main body of the developing device, printing quality deteriorates.

SUMMARY OF THE INVENTION

Accordingly, an aspect of the present invention is to provide an apparatus for recognizing the error of a toner sensor for a developing device that is capable of correctly recognizing the cause of the corresponding error in accordance with the output value of the sensor that senses the amount of the toner of the main body of the developing device to secure the reliability of the toner sensor and a method thereof.

According to an aspect of the present invention, there is provided an apparatus for recognizing error factors of a toner sensor for a developing device.

According to an aspect of the invention, the apparatus includes a toner container, at least one developing device main body detachably provided in the toner container to accommodate a toner supplied from the toner container, at least one developing device toner amount detector including a toner sensor for sensing the amount of the toner filled in the developing device main body to output a sensor value corresponding to the toner amount, a controller comparing the sensor value and a set value of the developing device toner amount detector with each other to recognize error information on the toner sensor and to display the recognized error information, and a display unit displaying the error information by control of the controller.

According to an aspect of the invention, the developing device toner amount detector further includes a converter converting the output of a sensor into digital data.

According to an aspect of the invention, the apparatus for recognizing error further includes a storage unit storing the error information.

According to an aspect of the invention, the storage unit writes down at least one error code corresponding to an error factor in a table to store the table.

According to an aspect of the invention, the error factor includes a case in which a toner supplying hole connected to the toner container is closed so that a toner is not normally supplied to the inside of the developing device main body.

According to an aspect of the invention, the error factor includes the case in which the amount of the toner in the developing device main body is wrongly recognized due to defect of the toner sensor.

According to an aspect of the invention, the toner sensor includes a light emitting unit and a light receiving unit and, when the light emitted from the light emitting unit is received by the light receiving unit to sense a toner, the error factor is generated due to defect of at least one of the light emitting unit and the light receiving unit.

According to an aspect of the invention, the error factor includes the case in which the sensor value is no more than a uniform value so that it is necessary to supply a toner to the developing device main body.

According to an aspect of the invention, there is provided a method of recognizing error information on a toner sensor provided in a developing device main body detachably provided in a toner container to accommodate a toner supplied from the toner container.

According to an aspect of the invention, the method includes comparing a sensor value and a set value of the toner sensor with each other, determining error information in accordance with the comparison result, and displaying the determined error information.

According to an aspect of the invention, the determining the error information includes detecting a table corresponding to an error factor in accordance with the sensor value and the error information includes an error code corresponding to an error factor.

According ton an aspect of the invention, the output of the toner sensor is converted into digital data and the sensor value of the sensor is obtained from the converted digital data.

According to an aspect of the invention, the sensor value of the toner sensor is obtained by averaging many sensor outputs.

Additional aspects and/or advantages of the invention will be set forth in part in the description which follows and, in part, will be obvious from the description, or may be learned by practice of the invention.

BRIEF DESCRIPTION OF THE DRAWINGS

These and other aspects and advantages of the invention will be apparent and more readily appreciated from the following description of the embodiments, taken in conjunction with the accompanying drawings of which:

FIG. 6 illustrates an example of a table stored in the storage unit of FIG. 5, in which the table includes information on an error code and an error content corresponding to the output value of a sensor that detects the amount of the toner of the main body of a developing device;

DETAILED DESCRIPTION OF THE EMBODIMENTS

Figure 1:
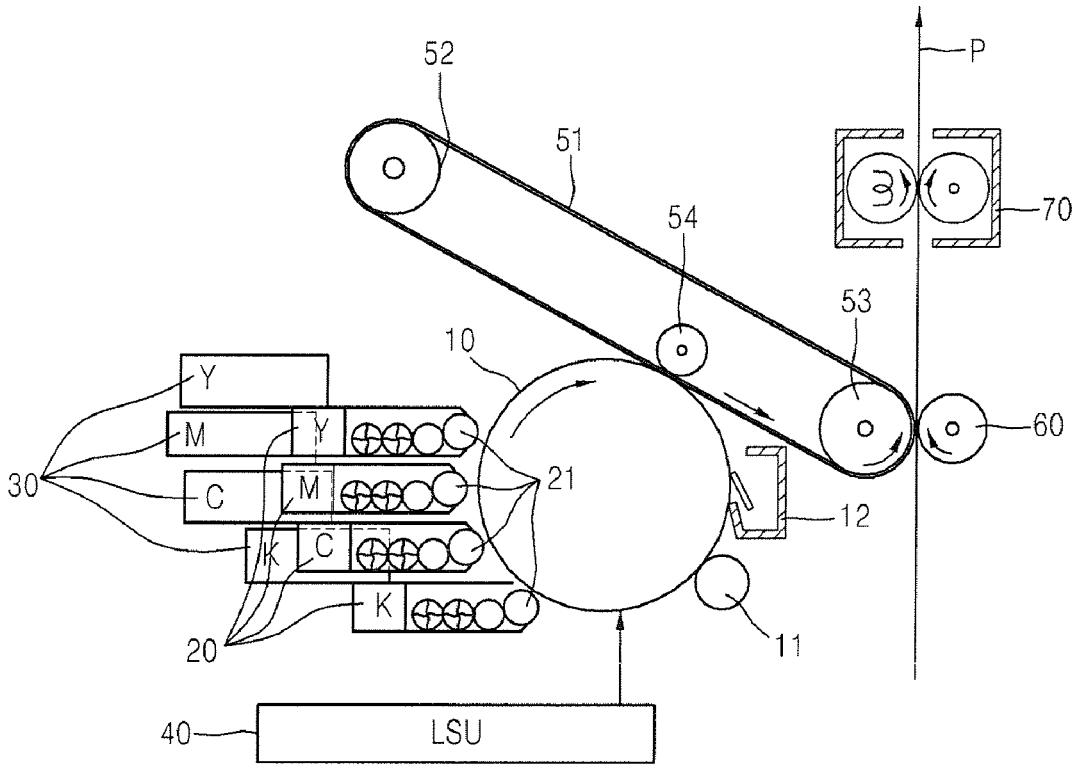
FIG. 1 is a schematic block diagram of a color image forming apparatus to which an error recognizing apparatus according to an aspect of the present invention is applied.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
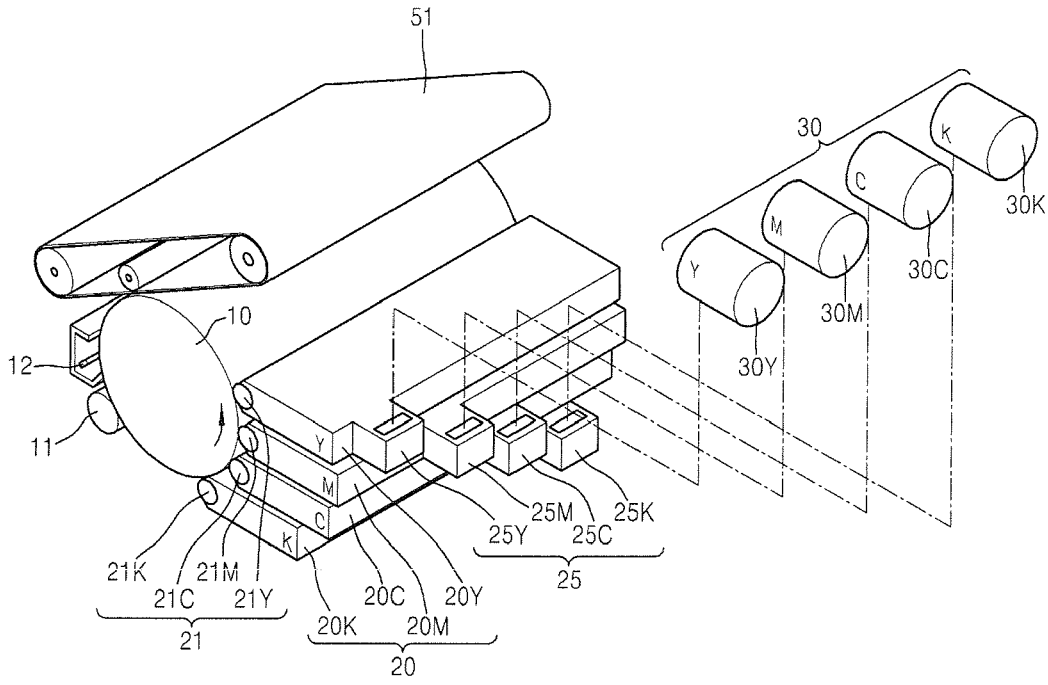
FIG. 2 is a perspective view illustrating the arrangements of the toner suppliers of the plurality of developing device main bodies of FIG. 1 and the toner containers corresponding to the toner suppliers.

Referring to FIGS. 1 and 2, an image forming apparatus according to an aspect of the invention includes a photosensitive drum 10, a plurality of developing device main bodies 20, a plurality of toner containers 30, an intermediate transferring belt 51, a first transferring roller 54, a second transferring roller 60, and a fixing device 70. The photosensitive drum 10 includes a light conductive layer formed on the outer circumference of a cylindrical metal drum. While not required in all aspects, a photosensitive belt can be used instead of the photosensitive drum 10. A charging roller 11 is adjacent to the outer circumference of the photosensitive drum 10 and charges the photosensitive drum 10 to a uniform electric potential. A cleaning unit 12 that removes the toner residing in the photosensitive drum 10 after a toner image is transferred to the intermediate transferring belt 51 is provided.

An exposing unit 40 scans the light corresponding to image information to the photosensitive drum 10 charged to have the uniform electric potential to form an electrostatic latent image. As shown, the exposing unit 40 comprises a laser scanning unit (LSU) that uses a laser diode as a light source is commonly used as the exposing unit 40. However, it is understood that the light can be provided by other devices.

To develop the electrostatic latent image formed in the photosensitive drum 10, the main bodies 20 receive toner from the toner containers 30. As shown, the toner containers 30 include a yellow toner container 30Y accommodating yellow (Y) toner, a magenta toner container 30M accommodating magenta (M) toner, a cyan toner container 30C accommodating yellow (Y) toner, and a black toner container 30K accommodating black (K) toner. The developing device main bodies 20 include a yellow main body 20Y to receive the yellow toner from the yellow toner container 30Y, a magenta main body 20M to receive the magenta toner from the magenta toner container 30M, a cyan main body 20C to receive the cyan toner from the cyan toner container 30C, and the black main body 20K to receive the black toner from the black toner container 30K. As shown in FIG. 1, the containers 30 are detached from the main bodies 20. While shown as four toners, it is understood that other numbers of toners can be used.

The developing device main bodies 20 each include developing rollers 21 separated from the photosensitive drum 10 by a developing gap. While not required in all aspects, the developing gap is preferably about several tens to several hundreds of microns.

In the shown image forming apparatus, the main bodies 20Y, 20M, 20C, and 20K sequentially operate to form an image, which is referred to as a multi-pass method. By way of example of the multi-pass method, where the color black is to be applied, a developing bias is applied to the developing roller 21K of a selected developing device main body 20K and developing biases are not applied to the developing rollers 21Y, 21M, and 21C of the remaining developing device main bodies 20Y, 20M, and 20C. Alternatively, development preventing biases that prevent the toner image from being developed may be applied to the developing rollers 21Y, 21M, and 21C of the remaining developing device main bodies 20Y, 20M, and 20C. Also, only the developing roller 21K of the selected developing device main body 20K may rotate and the developing rollers 21Y, 21M, and 21C of the remaining developing device main bodies 20Y, 20M, and 20C may not rotate. If another color (e.g., cyan) is being applied after the color black, the developing bias is applied to the main body 20C and/or the developing roller 21C is allowed to rotate, and the remaining developing device main bodies 20Y, 20M, and 20K are not biased toward the developing rollers 21Y, 21M, and 21K and/or the developing rollers 21Y, 21M, and 21K are not allowed to rotate. The process is repeated for each color or color combination being applied.

The plurality of developing device main bodies 20Y, 20M, 20C, and 20K, as illustrated in FIG. 2, are provided in parallel in the direction where the photosensitive drum 10 travels. Since the toner suppliers 25Y, 25M, 25C, and 25K of the plurality of developing device main bodies 20Y, 20M, 20C, and 20K are positioned to cross each other in the longitudinal direction of the developing device main bodies while extending from the main bodies 20Y, 20M, 20C, 20K, the plurality of toner containers 30Y, 30M, 30C, and 30K can be arranged not to interfere with each other. When the plurality of toner containers 30Y, 30M, 30C, and 30K are attached to and detached from the developing device main bodies 20Y, 20M, 20C, and 20K, the plurality of toner containers 30Y, 30M, 30C, and 30K can be arranged not to interfere with the developing device main bodies 20Y, 20M, 20C, and 20K and the toner containers 30Y, 30M, 30C, and 30K. However, it is understood that the other arrangement can be made which prevents interference between the containers 30Y, 30M, 30C, and 30K, and the developing device main bodies 20Y, 20M, 20C, and 20K need not be substantially parallel to each other in all aspects of the invention.

Figure 3:
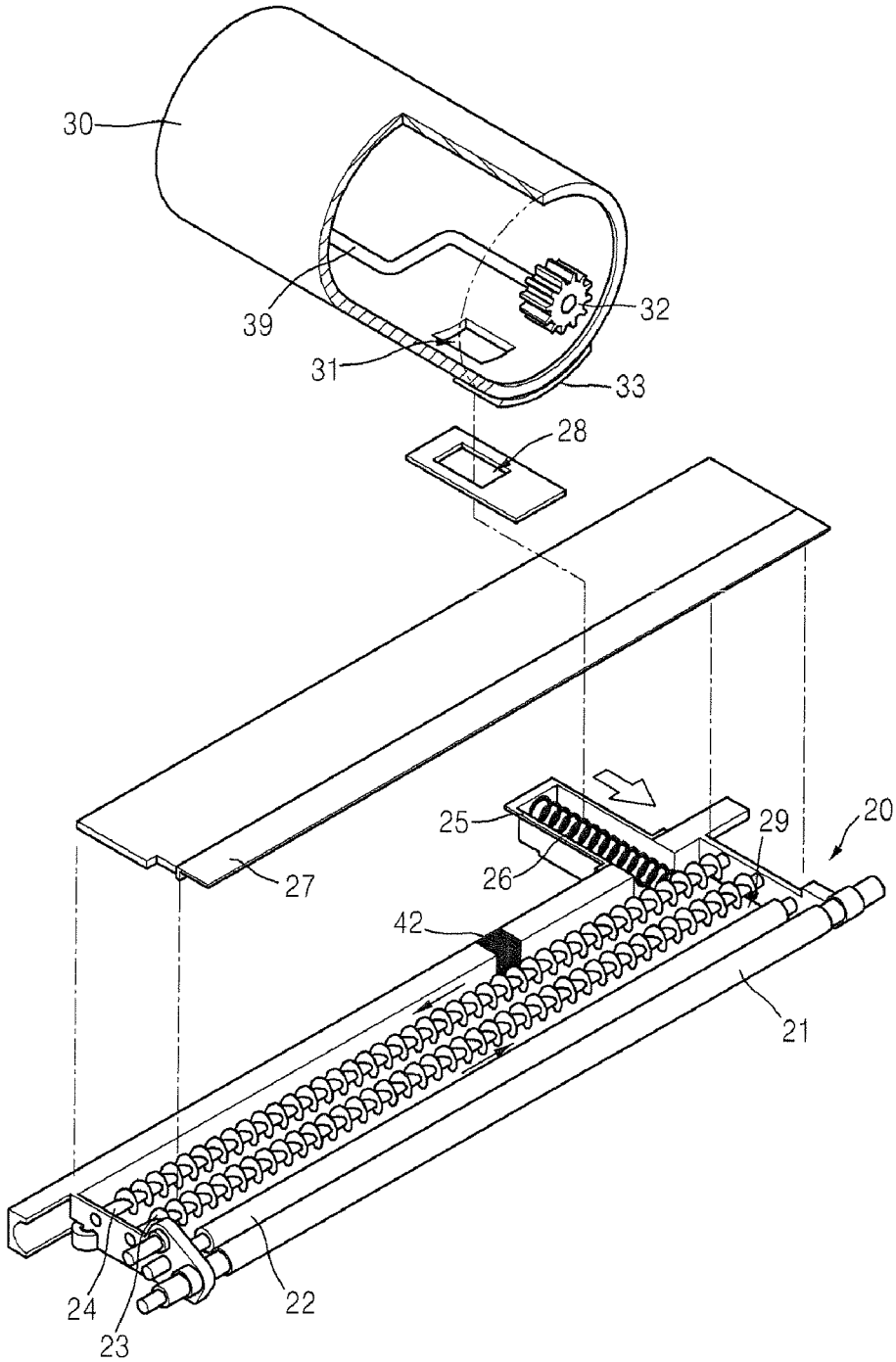
FIG. 3 is an exploded perspective view illustrating the main body of a developing device and a toner container, in which a toner in the toner container is supplied to the main body of the developing device.

FIG. 3 shows an embodiment of each of the toner containers 30Y, 30M, 30C, and 30K and main bodies 20Y, 20M, 20C, and 20K. Referring to FIG. 3, the developing device main body 20 includes an accommodating unit 29. The developing roller 21, a supplying roller 22, and a plurality of augers 23 and 24 are provided in the accommodating unit 29. A toner supplier 25 connects the accommodating unit 29 and the toner container 30 to each other. A transmitting unit 26 transmits a toner to the accommodating unit 29. A toner sensor 42 is disposed on the accommodating unit 29.

The developing roller 21 develops the electrostatic latent image formed in the photosensitive drum 10 using the toner. A restricting blade 27 restricts the thickness of the toner attached to the outer circumference of the developing roller 21 and is on the developing roller 21. The supplying roller 22 rotates while contacting the developing roller 21 to attach the toner (non-magnetic toner) to the developing roller 21 by a friction charge.

The plurality of augers 23 and 24 supply the toner supplied through the toner supplier 25 to the developing roller 21 and have a plurality of impellers. While not required in all aspects, the transmission directions of the plurality of augers 23 and 24 are preferably opposite to each other.

The toner supplier 25 is extended rearward from the accommodating unit 29. A supplying hole 28 is on the toner supplier and receives the toner from the toner container 30 into the toner supplying unit 25. A toner discharging hole 31 which connects to the supplying hole 28 is provided in the toner container 30. The toner container 30 includes a shutter 33 that opens and closes the toner discharging hole 31. Therefore, the shutter 33 opens the toner discharging hole 31 when the toner container 30 is mounted in the developing device main body 20, and closes the toner discharging hole 31 when the toner container 30 is separated from the developing device main body 20.

A supplier 39 supplies the toner stored in the toner container 30 to the toner discharging hole 31. The supplier 39 is connected to a gear 32 provided in one side of the toner container 30. Therefore, when the gear 32 receives power to rotate, the supplier 39 also rotates to transmit the toner stored in the toner container 30 to the toner discharging hole 31.

Figure 4:
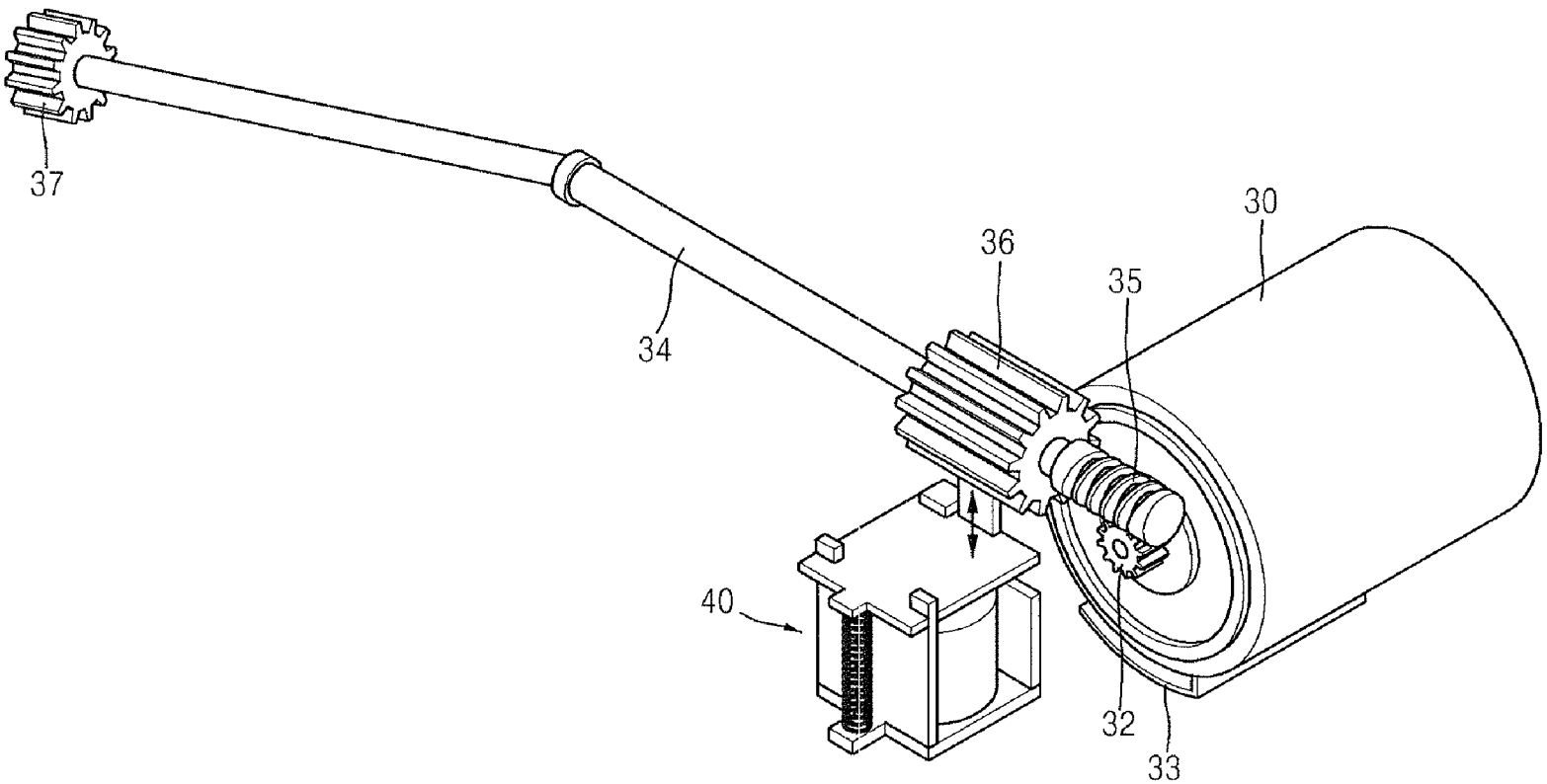
FIG. 4 is a perspective view illustrating that power is transmitted to the toner container by a solenoid.

FIG. 4 shows an embodiment of one of the toner containers 30Y, 30M, 30C, and 30K. Referring to FIG. 4, the gear 32 of the toner container 30 receives power through a connection gear 34 that transmits the power of a driving source (not shown) to rotate. A driving gear 37 connected to a driving source (not shown) to receive power is provided on one side of the connection gear 34 and a gear 35 connected to the gear 32 of the toner container 30 is provided on the other side of the connection gear 34. The driving source (not shown) can be included in the image forming apparatus and is controlled by a printer controller 100.

A solenoid 40 restricts the turning on or off of the gear 32 of the toner container 30. Since the solenoid 40 turns off or on the driving of the gear 35 while contacting or non-contacting a stopper 36 provided in the connection gear 34, the driving of the gear 32 of the toner container 30 is also controlled by turning on or off the solenoid 40.

The intermediate transferring belt 51 is supported by supporting rollers 52 and 53 to travel at the same traveling linear velocity as the rotating linear velocity of the photosensitive drum 10. The length of the intermediate transferring belt 51 is generally equal to or larger than the length of the paper P of the maximum size that is used for the image forming apparatus.

The first transferring roller 54 faces the photosensitive drum 10. A first transferring bias is applied to the first transferring roller 54 to transfer the toner image developed in the photosensitive drum 10 to the intermediate belt 51. A second transferring roller 60 faces the intermediate transferring belt 51. The second transferring roller 60 is separated from the intermediate transferring belt 51 while the toner image is transferred from the photosensitive drum 10 to the intermediate transferring belt 51. The second transferring roller 60 contacts the intermediate transferring belt 51 by predetermined pressure when the toner image is completely transferred to the intermediate transferring belt 51. A second transferring bias that transfers the toner image to the paper P is applied to the second transferring roller 60 to bias against the supporting roller 53. The fixing device 70 applies heat and pressure to the toner image transferred to the paper to fix the toner image to the paper.

The gear 32 of the toner container 30 is geared with the gear 35 of the connection gear 34 to rotate when the connection gear 34 rotates. When the solenoid 40 is turned off, the solenoid 40 contacts the stopper 36 so that the gear 32 of the toner container 30 is not driven. At this time, since the supplier 39 does not supply the toner to the toner discharging hole 31, the toner is not supplied to the developing device main body 20. When the solenoid 40 is turned on, the solenoid 40 is separated from the stopper 36 so that the gear 32 of the toner container 30 is driven. At this time, the supplier 39 supplies the toner to the toner discharging hole 31.

When the rotating speed ratio of the gear 32 of the toner container 30 is uniform and the time when the solenoid 40 is turned on is uniform, the gear 32 of the toner container 30 rotates for the time when the solenoid 40 is turned on so that the amount of the supplied toner is uniform. That is, the uniform amount of toner is supplied to the developing device main body 20 for the time when the solenoid 40 is turned on. Therefore, since the amount of toner applied is generally equal for each time the solenoid 40 is turned on, it is possible to estimate the total amount of the supplied toner when the total number of times at which the solenoid 40 is turned on is measured.

The number of times at which the solenoid 40 is turned on can be calculated using a recording medium (counting memory) described later. Therefore, it is possible to measure the total number of times at which the solenoid 40 is turned on.

The toner sensor 42 that measures the amount of the toner accommodated in the developing device main body 20 is provided in the developing device main body 20. According to an aspect of the invention, the toner sensor 42 includes a light emitting unit and a light receiving unit so that the light emitted from the light emitting unit is received by the light receiving unit and that output is made to correspond to the amount of the toner in accordance with the amount of the light received by the light receiving unit.

Figure 5:
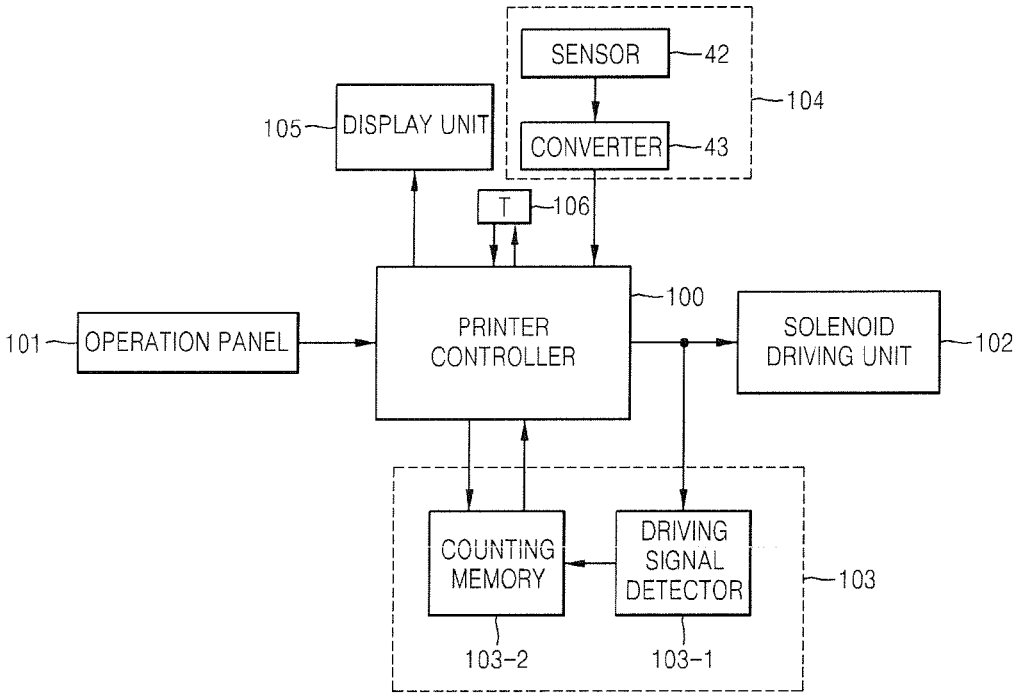
FIG. 5 is a block diagram of an error recognizing apparatus according to an aspect of the present invention that is applied to a printer.

As illustrated in FIG. 5, when an example of the image forming apparatus is applied to a printer, the apparatus for recognizing the error of the toner sensor according to an aspect of the present invention includes a printer controller 100 that controls the operation of the printer in response to the printing command input through an operation panel 101. A solenoid driving unit 102 drives the solenoid 40 and is electrically connected to the output side of the printer controller 100. In FIG. 5, one solenoid driving unit 102 is illustrated. However, when the toner containers 30Y, 30M, 30C, and 30K of the plurality of colors are included, a plurality of solenoids are provided to correspond to the corresponding toner containers 30Y, 30M, 30C, and 30K and the plurality of solenoid driving units may be provided to correspond to the plurality of solenoids.

The solenoid driving unit 102 turns on or off the solenoid 40 in accordance with the toner supply control signal of the printer controller 100. As the solenoid 40 is turned on or off, it is possible to control the supply of the toner to the developing device main body 20.

A toner container toner amount detector 103 that measures the total number of times at which the solenoid 40 is turned on to calculate the amount of the toner left in the corresponding toner container 30Y, 30M, 30C, 30K is connected to the printer controller 100. The toner container toner amount detector 103 includes a driving signal detector 103-1 that receives one end of the toner supply control signal output from the printer controller 100 to detect the driving signal (on) of the solenoid driving unit 102 and to output a detection signal in accordance with the detection result. A counting memory 103-2 calculates the total number of times at which the solenoid 40 is turned on based on the detection signal of the driving signal detector 103-1 and stores the total number of times. However, it is understood that other mechanisms can be used to estimate an amount of toner that has been used, such as a number of pages which have been printed, a number of rotations that the gear 32 is turned, or other like measurement techniques.

The printer controller 100 requests to detect from the counting memory 103-2 to receive information on the total number of times at which the solenoid 40 is turned on. The printer controller 100 can recognize the amount of the toner left in the corresponding toner container 30Y, 30M, 30C, 30K using the total number of times found by detecting the counting memory 103-2. Therefore, a storage unit 106 includes a table T that previously writes down information on the amount of the toner of the corresponding toner container 30Y, 30M, 30C, 30K corresponding to the total number of times at which the solenoid 40 is turned on. The table T can be calculated from experimental results.

When it is determined that the toner amount CT found by detecting the counting memory 103-2 is not larger than a reference toner amount LT (that is, the amount of the toner left in the corresponding toner container 30Y, 30M, 30C, 30K is less than a proper amount), the printer controller 100 applies a toner supply signal for turning on the solenoid 40 to the solenoid driving unit 102. A developing device toner amount detector 104 detects the amount of the toner left in the corresponding developing device main body 20Y, 20M, 20C, 20K and is connected to the printer controller 100. In FIG. 5, one developing device toner amount detector 104 is illustrated. However, when the toner containers 30Y, 30M, 30C, 30K of the plurality of colors are included, the plurality of developing device main bodies 20Y, 20M, 20C, 20K are included to correspond to the corresponding toner containers 30Y, 30M, 30C, 30K and the plurality of developing device toner amount detectors may be included to correspond to the toner containers 30Y, 30M, 30C, 30K.

The developing device toner amount detector 104 includes the toner sensor 42 and a converter 43 that converts the output of the toner sensor 42 into digital data. The resolving power of the toner sensor 42 is determined by the number of bits assigned to the digital data. According to the shown embodiment, the resolving power is 8 bits. However, the present invention is not limited to the 8 bit resolving power.

The printer controller 100 determines the amount of the toner left in the corresponding developing device main body 20Y, 20M, 20C, 20K based on the digital data provided from the converter 43 of the developing device toner amount detector 104 and can know whether an adequate amount of toner is left in the developing device main body 20Y, 20M, 20C, 20K based on the digital data. Information on the toner amount obtained by the toner sensor 42 is not always reliable. As illustrated in FIG. 6, error codes are stipulated to correspond to various error factors and to display on the display unit 105 the error code corresponding to the error factor determined by the sensor value so that measures corresponding to the error code are taken.

Figure 7:
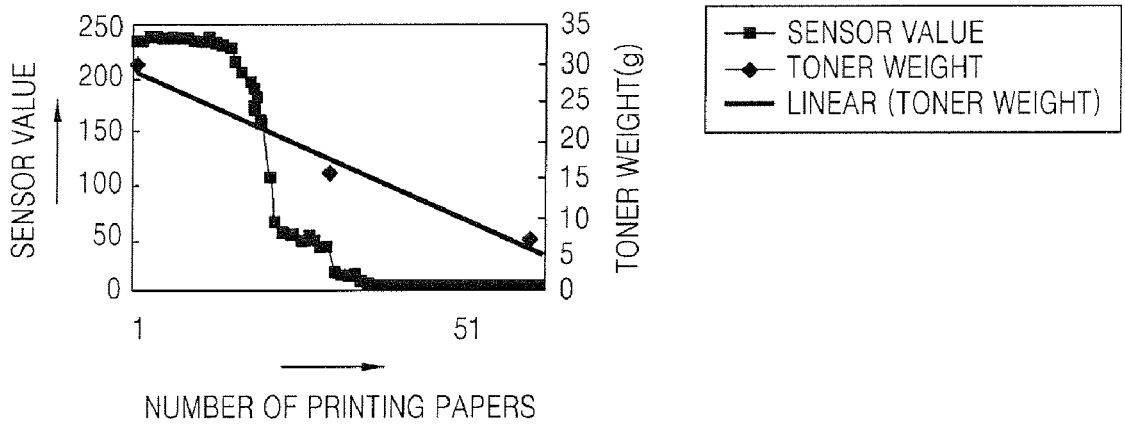
FIG. 7 is a graph illustrating the weight of the toner left in the main body of the developing device corresponding to the output value of the sensor when printing is performed in a state where the toner container is separated and the main body of the developing device is filled with the toner of a magenta color.

FIG. 7 shows the result of an experiment. In the experiment, the developing device main body 20M was filled with only the toner of the magenta color to continue printing in a state where the toner container 30M is separated. As a result, as illustrated in FIG. 7, the sensor value from the sensor 42 changes as the number of printing papers increases and that the weight (g) of the toner is reduced. Based upon these results, the error codes E1 through E5 shown in FIG. 6 are selectively displayed.

Referring to FIG. 6, the error code E1 represents that the sensor value is no more than 15. In this case, the toner supplying hole 25 of the developing device main body 20 is closed (contaminated) so that the toner is not normally supplied to the inside of the developing device main body 20.

The error code E2 represents that the sensor value is no less than 250. In this case, a small amount of light is received by the light receiving unit of the sensor 42 due to the defect of the light emitting unit of the toner sensor 42, in which the amount of the toner may be different from the amount of the toner of the developing device main body 20.

The error code E3 represents that the sensor value is fixed to a uniform value. In this case, the light emitted by the light emitting unit is not normally received due to the defect of the light receiving unit of the toner sensor 42. The sensor value is fixed based upon the specific type of sensors used (such as the type of emitting/receiving units), and is experimentally determined to occur at a predetermined high level. In the shown example in FIG. 6, the error represents a short in the circuit of the light receiving unit of the sensor 42.

The error code E4 represents that the sensor value is not more than a uniform value (Te). An example of Te is 30, but is not restricted there to. In this case, the toner of the developing device main body 20 is exhausted so that it is necessary to supply a toner to the developing device main body 20.

The error code E5 represents that the sensor value is no more than 15. In this case, the agitation of the toner in the developing device main body 20 is not properly performed so that the toner is inclined to deviate from the sensing region of the sensor 42.

As described above, when the corresponding error factors are determined based on the sensor value output from the toner sensor 42, it is preferable that information on the amount of the toner is obtained many times through the toner sensor 42 while printing is performed on a recording medium, the obtained information items are averaged, and the error factor is determined based on the sensor value.

When the error factor is determined in accordance with the sensor value provided by the developing device toner amount detector 104, the printer controller 100 displays an error factor on the display unit 105 and displays a guide message for taking the corresponding measures.

Figure 8A:
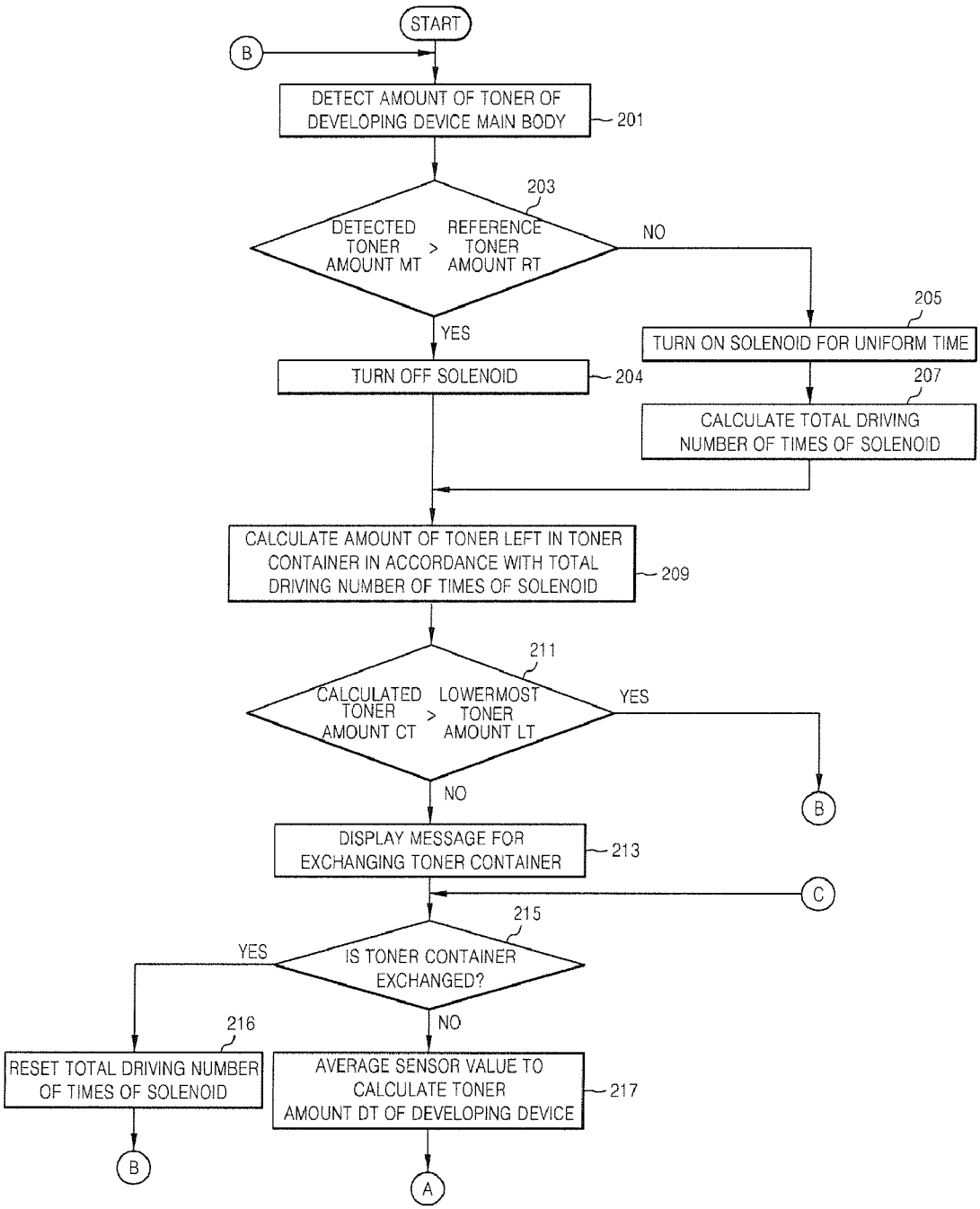
FIGS. 8A and 8B are flowcharts illustrating an error recognizing method according to an aspect of the present invention.
Figure 8B:
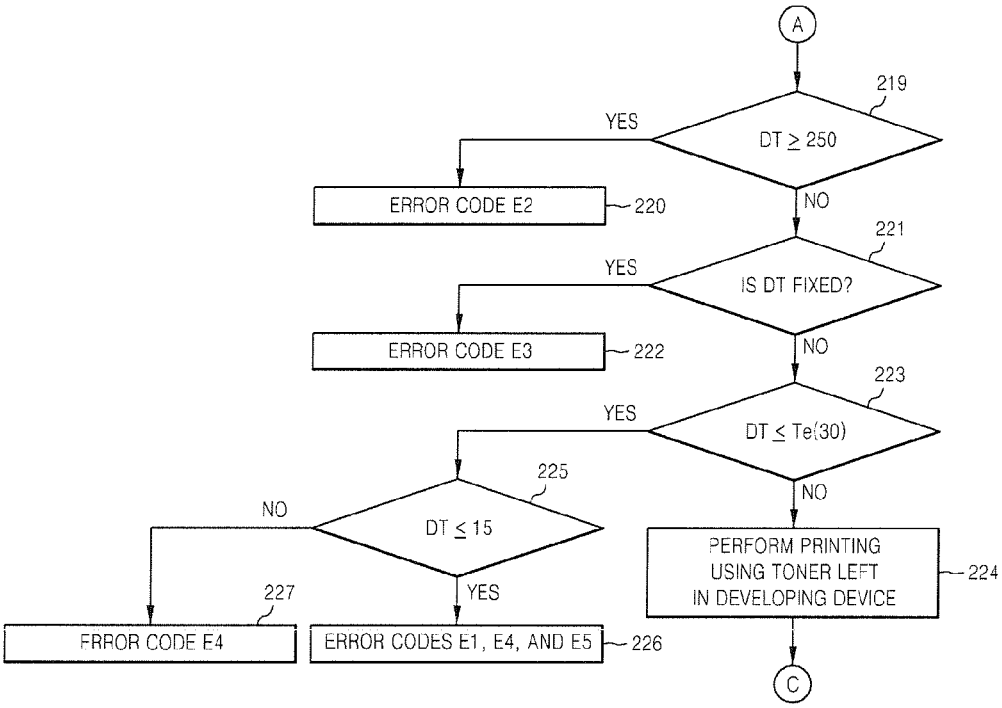

A method of recognizing error according to an aspect of the present invention described above will be described with reference to the FIGS. 8A and 8B. In operation 201, the printer controller 100 detects the amount MT of the toner left in the corresponding developing device main body 20Y, 20M, 20C, 20K through the developing device toner amount detector 104 to respond to the printing command from the operation panel 101 while a power source is supplied to the apparatus so that initialization is performed.

The detected toner amount MT and the reference toner amount RT set in order to determine whether a proper amount of toner is left are compared with each other (operation 203). When it is determined that the detected toner amount MT is larger than the reference toner amount RT, that is, the proper amount of toner is left in the corresponding developing device main body 20Y, 20M, 20C, 20K, the solenoid 40 is turned off (operation 204). When it is determined that the toner amount MT is not larger than the reference toner amount RT (that is, the proper amount of toner is not left in the corresponding developing device main body 20Y, 20M, 20C, 20K), the printer controller 100 applies the toner supply signal to the solenoid driving unit 102 so that the solenoid 40 is turned on for a uniform time (operation 205) and the toner in the corresponding toner container 30Y, 30M, 30C, 30K is supplied to the corresponding developing device main body 20Y, 20M, 20C, 20K. At this time, the driving signal detector 103-1 of the toner container toner amount detector 103 receives the toner supply signal to detect the driving number of times and the counting memory 103-2 calculates and stores the total number of times the solenoid 40 is turned on (operation 207). However, it is understood that operation 205 need not be performed in all aspects of the invention.

The printer controller 100 estimates the amount of the toner supplied to the corresponding developing device main body 20Y, 20M, 20C, 20K in accordance with the total driving number of times of the solenoid 40 stored in the counting memory 103-2 and calculates the amount of the toner left in the toner container 30 based on the amount of the toner supplied to the corresponding developing device main body 20Y, 20M, 20C, 20K to produce a calculated amount CT (operation 209).

In operation 211, the printer controller 100 compares the calculated toner amount CT and a previously set lowermost toner amount LT with each other. When it is determined that the calculated toner amount CT is larger than the lowermost toner amount LT, it is determined that the proper amount of toner is left in the toner container 30Y, 30M, 30C, 30K. In this case, the process returns to the operation 201 in order to normally perform printing. When it is determined the calculated toner amount CT is not larger than the lowermost toner amount LT, it is determined that the proper amount of toner is not left in the corresponding toner container 30Y, 30M, 30C, 30K to display a message for exchanging the toner container on the display unit 105 (operation 213). However, it is understood that operation 215 need not be performed prior to operation 219, such as where replacement of the toner container 30Y, 30M, 30C, 30K is not confirmed until after it is determined that the toner container 30Y, 30M, 30C, 30K hole is not plugged.

It is determined whether to exchange the toner container 30 after the message for exchanging the corresponding toner container 30Y, 30M, 30C, 30K is displayed (operation 215). While not required in all aspects, it is determined whether to exchange the toner container 30Y, 30M, 30C, 30K by a unit for detecting the exchange of the toner container 30Y, 30M, 30C, 30K that is adopted in the method of separating the toner container 30Y, 30M, 30C, 30K from the corresponding developing device main body 20Y, 20M, 20C, 20K. It is preferable, but not required, that a mounting signal is applied to the printer controller 100 by a switch (not shown) when the corresponding toner container 30Y, 30M, 30C, 30K is mounted. However, it is not limited to the above. A unit whose mounting is recognized by the printer controller 100 may be adopted. A conventionally developed unit may be used and those skilled in the art can understand the unit although detailed description is omitted.

When it is determined in the operation 215 that the toner container 30Y, 30M, 30C, 30K is exchanged with a new toner container 30Y, 30M, 30C, 30K, the printer controller 100 resets the total driving number of times of the solenoid accumulated in the counting memory 103-2 in operation 216, and the process returns to the operation 201 in order to normally perform printing.

When it is determined in the operation 215 that the toner container 30Y 30M, 30C, 30K is not exchanged with a new toner container (that is, the toner container 30Y, 30M, 30C, 30K is not exchanged with a new toner container 30 such as due to the carelessness of a user although the message for exchanging the toner container is displayed on the display unit 105), it is possible to perform printing in accordance with the printing command using the toner in the corresponding developing device main body 20Y, 20M, 20C, 20K. At this time, since the toner is not stably supplied from the toner container 30Y, 30M, 30C, 30K, the printer controller 100 checks the generation of the error of the toner sensor 42. That is, while printing is performed in response to the printing command, the printer controller 100 obtains the sensor value from the toner sensor 42 many times and averages the obtained sensor values to calculate the amount of the toner left in the developing device main body 20 (operation 217).

It is determined whether the calculated developing device toner amount DT is no less than 250 (operation 219). When it is determined that the developing device toner amount DT is no less than 250, the table T of the storage unit 106 is detected to find the error code E2 and the error code E2 is displayed on the display unit 105 so that the user repair the toner supplying hole of the developing device (operation 220).

When the calculated developing device toner amount DT is smaller than 250, it is determined whether the developing device toner amount DT is fixed to a uniform value (operation 221). When it is determined the developing device toner amount DT is fixed, the table T of the storage unit 106 is detected to find the error code E3 and the error code E3 is displayed on the display unit 105 so that the user can repair the toner sensor 42 (operation 222).

When it is determined in the operation 221 that the developing device toner amount DT is not fixed, it is determined whether the developing device toner amount DT is no more than a uniform value Te (for example, 30) (operation 223). When it is determined that the calculated developing device toner amount DT is larger than Te, since it is determined that the proper amount of toner is left in the developing device main body 20, printing is performed using the toner (operation 224). Then, the process returns to the operation 215.

When it is determined in the operation 223 that the calculated developing device toner amount DT is no more than Te, it is determined whether the calculated developing device toner amount DT is no more than 15 (operation 225).

When it is determined in the operation 225 that the calculated developing device toner amount DT is no more than 15, the table T of the storage unit 106 is detected to find the plurality of corresponding error codes E1, E4, and E5 and to display the error codes E1, E4, and E5 on the display unit 105 so that the user examine the error codes E1, E4, and E5 and take measures corresponding to the error codes E1, E4, and E5 (operation 226).

When it is determined in the operation 225 that the calculated developing device toner amount DT is larger than 15 and no more than Te, the table T of the storage unit 106 is detected to display the error code E4 on the display unit 105 so that the user recognizes that the toner in the corresponding developing device main body 20Y, 20M, 20C, 20K is insufficient and that printing quality may deteriorate to prevent the user from unnecessarily performing printing (operation 227).

As described above, according to aspects of the present invention, when printing is performed using the toner left in the developing device main body in a state where the amount of the toner in the toner container is insufficient so that it is difficult to supply the toner to the developing device main body, various error factors are recognized in accordance with the output values of the toner sensor to be displayed so that the user take measures corresponding to the error factors. Therefore, it is possible to improve the reliability of the toner sensor.

While described in terms of a cartridge with a separate structure in which the toner container is separate from the main body, it is understood that aspects of the invention can be implemented using a monolithic structure in which the toner is stored in the developing cartridge. Moreover, it is understood that aspects of the invention can be implemented as software encoded on one or more computer readable media and read by a computer, a controller, or a microprocessor.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus for recognizing error factors of a toner sensor for a developing device, the apparatus comprising:

a toner container to hold toner;

at least one developing device main body detachably provided to the toner container to receive the toner supplied from the toner container;

at least one developing device toner amount detector including a toner sensor to sense an amount of the toner filled in the developing device main body and to output a sensor value corresponding to the sensed amount;

a controller to compare the output sensor value with one or more of a plurality of set values, to identify one of a plurality of error types associated with the toner sensor in accordance with the comparison result, each of the plurality of error types indicated by error information associated with a respective predetermined relationship between a sensor value and one of the plurality of set values, and to control a display of the recognized error information; and a display unit controlled by the controller to display the recognized error information.

2. The apparatus as claimed in claim 1, wherein the developing device toner amount detector further comprises a converter to convert an output of the toner sensor into digital data such that the output sensor value comprises the digital data.

3. The apparatus as claimed in claim 1, further comprising a storage unit storing the error information and which is retrieved by the controller according to the comparison to be displayed on the display unit.

4. The apparatus as claimed in claim 3, wherein the storage unit stores a table comprising at least one error code corresponding to the error type.

5. The apparatus as claimed in claim 4, wherein:

the toner container comprises a toner supplying hole through which the toner is supplied from the toner container to an inside of the developing device main body, and the table comprises another stored error code for an error not due to the toner sensor and which is due to the toner supplying hole being closed so that the toner is not normally supplied from the toner container to the inside of the developing device main body.

6. The apparatus as claimed in claim 4, wherein the error code comprises an error due to the toner sensor incorrectly sensing the amount of the toner in the developing device main body due to a defect of the toner sensor.

7. The apparatus as claimed in claim 6, wherein:

the toner sensor comprises a light emitting unit and a light receiving unit, and, when light emitted from the light emitting unit is received by the light receiving unit to sense the toner, the error is generated due to a defect of the light emitting unit and/or the light receiving unit.

8. The apparatus as claimed in claim 4, wherein another one of the error codes comprises an error due to the sensor value is no more than a uniform value so that it is necessary to supply a toner to the developing device main body.

9. A method of recognizing error information on a toner sensor provided in a developing device main body detachably provided to a toner container to receive a toner supplied from the toner container, the method comprising:

comparing a sensor value detected by the toner sensor with one or more of a plurality of set values to obtain a comparison result;

identifying one of a plurality of error types associated with the toner sensor in accordance with the comparison result, each of the plurality of error types indicated by error information associated with a respective predetermined relationship between a sensor value and one of the plurality of set values; and displaying the identified error type.

10. The method as claimed in claim 9, wherein:

determining the error information comprises detecting a table storing error codes relating to corresponding sensor values, and the error information comprises the error code corresponding to the comparison result.

11. The method as claimed in claim 9, further comprising converting the output of the toner sensor into digital data, wherein the comparing the sensor value comprises comparing the converted digital data with the set value.

12. The method as claimed in claim 9, further comprising determining the sensor value of the toner sensor as an average of multiple sensor outputs output from the toner sensor.

13. A toner sensor diagnostic system for detecting and diagnosing a toner sensor used to sense an amount of toner in a developing cartridge, the system comprising:

a memory to store a table of sensor error codes organized according to corresponding sensor values, each sensor error code reflecting a different error condition of the toner sensor; and a controller to receive a sensor value from the toner sensor which reflects an amount of the toner which the toner sensor detects in the developing cartridge, to compare the sensor value with one or more of a plurality of set values, and to identify one of a plurality of error types associated with the toner sensor in accordance with comparison result, each of the plurality of error types indicated by error information associated with a respective predetermined relationship between a sensor value and one of the plurality of set values.

14. The toner sensor diagnostic system as claimed in claim 13, wherein the table comprises:

a first stored sensor value corresponding to when the toner sensor is shorted, and a second stored sensor value corresponding to when a light emitter/receiver of the toner sensor is defective.

15. The toner sensor diagnostic system as claimed in claim 14, wherein the table further comprises sensor values reflecting problems in the developing cartridge not related to the toner sensor.

16. The toner sensor diagnostic system as claimed in claim 13, wherein:

the table stores another error code not related to a toner sensor error, and when there is a likely toner sensor error, the controller further:

determines from the comparison of the received sensor value with the stored sensor values that the error relates to the toner in the developing cartridge and does not relate to the toner sensor, and outputs the another error code corresponding to the received sensor value.

17. The toner sensor diagnostic system as claimed in claim 16, wherein the table comprises:

a first stored sensor value corresponding to when the toner sensor is shorted, and a second stored sensor value corresponding to when a light emitter/receiver of the toner sensor is defective.

18. The toner sensor diagnostic system as claimed in claim 17, wherein the table further comprises:

a third stored sensor value reflecting a lack of toner in the developing cartridge, a fourth stored sensor value reflecting a contamination in the developing cartridge which prevents toner distribution; and a fifth stored sensor value reflecting a need to agitate the toner in the developing cartridge.

19. The toner sensor diagnostic system as claimed in claim 13, wherein the controller, to determine whether there is a likely toner sensor error, calculates an amount of toner in the developing cartridge from a detected amount of time that the developing cartridge has been engaged to supply toner, compares the calculated amount of toner with a predetermined number to obtain a first comparison result, compares the received sensor value with another predetermined number to obtain a second comparison result, and determines when there is the likely toner sensor error according to the first and second comparison results.

20. The toner sensor diagnostic system as claimed in claim 13, wherein the controller determines that there is a likely toner sensor error by estimating that the amount of toner is below a first predetermined number, with the first predetermined number being less than one of the stored sensor values, and determining that the received sensor value corresponds to the one stored sensor value.

21. The toner sensor diagnostic system as claimed in claim 13, wherein the controller determines that there is a likely toner sensor error based upon an estimated amount of toner being below a first predetermined number, with the first predetermined number being less than one of the stored sensor values, and determining that the received sensor value is fixed at a sensor value indicating that the toner sensor has shorted.

22. The toner sensor diagnostic system as claimed in claim 21, further comprising a counter memory which detects and stores a number of times the controller activates a solenoid while the developing cartridge supplies the toner, wherein the controller retrieves the stored number of times to estimate the amount of toner.

23. The toner sensor diagnostic system as claimed in claim 13, wherein the controller further receives another sensor value from another toner sensor which reflects an amount of another toner which the another toner sensor detects in another developing cartridge, to determine whether the received another sensor value indicates a likely toner sensor error, and when there is the likely toner sensor error, to compare the received another sensor value with the stored sensor values in the table and output the error code corresponding to the received another sensor value.

24. An image forming device comprising the toner sensor diagnostic system as claimed in claim 13, further comprising a printing unit which uses the toner supplied by the developing cartridge to form images on a medium, wherein the controller further controls the printing unit to form the image and controls the developing cartridge to supply the toner to the printing unit.

* * * * *